United States Patent [19]

Nagano et al.

[11] 4,276,133

[45] Jun. 30, 1981

[54] METHOD FOR CONTINUOUS ELECTROLYTIC DESCALING OF STEEL WIRE BY NON-CONTACT CURRENT FLOW

[75] Inventors: Hiroo Nagano, Kobe; Terumi Oda, Muko; Takashi Fukuda, Kobe, all of Japan

[73] Assignee: Sumitomo Industries, Ltd., Osaka, Japan

[21] Appl. No.: 78,512

[22] Filed: Sep. 24, 1979

[30] Foreign Application Priority Data

Sep. 21, 1978 [JP] Japan ..... 53-116877

[51] Int. Cl.[3] ..... C25F 1/06

[52] U.S. Cl. ..... 204/145 R

[58] Field of Search ..... 204/145 R

[56] References Cited

U.S. PATENT DOCUMENTS

| | | | |
|---|---|---|---|
| 570,956 | 11/1896 | Ramage | 204/145 R |
| 1,041,790 | 10/1912 | Herrmann | 204/145 |
| 1,305,213 | 5/1919 | Hoffman | 204/145 |
| 1,369,271 | 2/1921 | Edison | 204/141 |
| 1,950,689 | 3/1934 | Nachtman | 204/145 |
| 2,037,633 | 4/1936 | Kelvie | 204/145 |
| 2,165,326 | 7/1939 | Yerger | 204/145 |
| 2,174,722 | 10/1939 | Herrmann | 204/145 |
| 2,307,928 | 1/1943 | Hogaboom | 204/141 |
| 3,043,758 | 7/1962 | Machu | 204/145 |
| 3,429,792 | 2/1969 | Fukui | 204/145 |
| 3,507,767 | 4/1970 | Stricker | 204/145 |
| 4,129,485 | 12/1978 | Shikata | 204/145 R |

FOREIGN PATENT DOCUMENTS

| | | | |
|---|---|---|---|
| 240674 | 10/1964 | Austria | 204/145 R |
| 50-47827 | 4/1975 | Japan | 204/145 R |
| 53-031902 | 9/1978 | Japan | 204/145 R |
| 19785 | of 1899 | United Kingdom | 204/145 R |
| 566538 | 1/1945 | United Kingdom | 204/145 R |
| 1098715 | 1/1968 | United Kingdom | 204/145 |

*Primary Examiner*—T. M. Tufariello

*Attorney, Agent, or Firm*—Stevens, Davis, Miller & Mosher

[57] ABSTRACT

Electrolytic descaling of a steel wire is carried out at a high current density by a non-contact flow method in the presence of ferrous ions in the electrolyte to prevent the consumption of electrodes.

8 Claims, 3 Drawing Figures

METHOD FOR CONTINUOUS ELECTROLYTIC DESCALING OF STEEL WIRE BY NON-CONTACT CURRENT FLOW

The present invention relates to a method and an apparatus for continuous electrolytic descaling of a steel wire by non-contact current flow, and more particularly, to a method and an apparatus for efficiently effecting the electrolytic descaling of a steel wire to provide steel wire of good quality using a current density approximately ten times higher than the current density usually used in the prior art without formation of gases on the electrode surfaces and without significant loss of electrode material.

The inventors of the present invention have invented an apparatus for continuous electrolytic descaling of a steel wire by non-contact current flow and filed an application for patent (Japanese patent application No. 21991/1977).

According to the disclosure made in the above mentioned application, (1) an aqueous solution of alkali metal chloride, such as sodium chloride (NaCl), potassium chloride (KCl), lithium chloride (LiCl) etc., or (2) an aqueous solution of alkali metal sulfate, such as sodium sulfate ($Na_2SO_4$), potassium sulfate ($K_2SO_4$) etc. is used as an electrolyte. In addition, the temperature of an electrolyte is adjusted to between room temperature and a temperature lower than 100° C. and the electrolyte is recycled at a rate of more than 0.1 m/sec. The electrode material may be titanium, zirconium, tantalum, carbon, stainless steel, etc. Particularly, graphite is suitable for a non-contact current flow method in which an aqueous solution of sodium chloride or potassium chloride is used as an electrolyte and lead is suitable in using an aqueous solution of sodium sulfate or potassium sulfate as an electrolyte in view of their corrosion resistance and economy. The electrode may be in the form of plate or tube.

However, in a method for electrolytic descaling of a steel wire, such as referred to in the above mentioned application, the current density has been limited to lower than 50 A/dm$^2$ (500 mA/cm$^2$). This is because at a current density of higher than 50 A/dm$^2$ a remarkable consumption loss of the electrode is inevitable.

In case of an electrolyte comprised of an aqueous solution of alkali metal chloride, chlorine gas formed during operation is converted to hypochlorous acid (HClO) in accordance with the following equation:

$$Cl_2 + H_2O \rightarrow HClO + HCl \quad (1)$$

The resulting corrosive hypochlorous acid accelerates the consumption of a graphite electrode.

In case of an electrolyte comprised of an aqueous solution of alkali metal sulfate, the lead electrode is easily dissolved into the electrolyte in accordance with the following equation:

$$Pb \rightarrow Pb^{2+} + 2e^- \quad (2)$$

The term "non-contact current flow" used herein is to be understood that current flows through the steel wire being processed without any direct contact with either electric power source or electrodes.

The object of the present invention is to provide a method for electrolytic descaling of a steel wire eliminating these disadvantages of the prior art.

Another object of the present invention is to provide a method of preventing the formation of chlorine gas and dissolution of electrode material to make it possible to raise the current density to higher than 50 A/dm$^2$.

Still another object of the present invention is to provide an efficient method for electrolytic descaling of a steel wire by raising the current density without significant loss of electrode material.

Further, an object of the present invention is to provide an apparatus for efficiently carrying out the above mentioned method.

The inventors of the present invention completed this invention after extensive study and experiments with the aim in mind of achieving these objects.

The inventors found that the presence of ferrous ions ($Fe^{2+}$) in an electrolyte composed of an aqueous alkali metal salt successfully eliminates these prior art disadvantages even under operations using a current density higher than 50 A/dm$^2$.

Thus, the present invention is characterized by incorporating ferrous ions in an electrolyte as an inhibitor to the consumption of electrode. The ferrous ion may be derived from ferrous chloride or sulfate.

According to one embodiment of the invention, therefore, in the case in which the electrolyte is comprised of an aqueous solution of an alkali metal chloride and graphite electrodes are used, ferrous chloride is added to the electrolyte and the electrolytic descaling of a steel wire is carried out in the presence of ferrous ions by the non-contact current flow method.

According to another embodiment of the invention, in which the electrolyte is comprised of an aqueous solution of an alkali metal sulfate and lead electrodes are used, ferrous sulfate is added to the electrolyte and the electrolytic descaling of a steel wire is carried out in the presence of ferrous ions by the non-contact current flow method.

Thus, the consumption of graphite electrodes and dissolution of lead electrodes are prevented successfully, making it possible to carry out electrolytic descaling at a current density higher than 50 A/dm$^2$ by the non-contact current flow method, since the present invention employs ferrous ions as an inhibitor of corrosion and dissolution of electrode material. However, instead of formation of chlorine gas and dissolution of lead electrode, a large amount of sludge is formed in the present invention resulting from descaling of wire. It is necessary to provide in the system of the present invention a means of removing sludge.

Therefore, the present invention is also characterized by an apparatus for electrolytic descaling of a steel wire, in which an electrolyte circulating system is provided including a means of removing sludge and a means of adjusting the concentration of ferrous ions in the electrolyte.

In summary, according to the present invention due to the presence of ferrous ions in the electrolyte and the removal of sludge from the electrolyte circulating system, electrolytic descaling proceeds successfully and continuously at a high current density to give the wire surface a bright finish.

The mechanism of preventing loss of electrode by the addition of ferrous ions to the electrolyte can be explained as follows.

In case of a graphite electrode and an electrolyte of aqueous sodium chloride, anodic reactions take place in the absence of ferrous ions as follows:

$$2H_2O \rightarrow O_2 + 4H^+ + 4e^- \quad (3)$$

$$2Cl^- \rightarrow Cl_2 + 2e^- \quad (4)$$

The chlorine gas thus formed attacks the electrode causing weight loss of the electrode as hereinbefore mentioned. On the contrary, in the presence of ferrous ions, the following reaction takes place instead of reactions (3) and (4) to suppress the formation of corrosive chlorine gas.

$$Fe^{2+} \rightarrow Fe^{3+} + e^- \quad (5)$$

In case of a lead electrode and an electrolyte of an aqueous solution of sodium sulfate, anodic reactions take place in the absence of ferrous ions as follows.

$$2H_2O \rightarrow O_2 + 4H^+ + 4e^- \quad (6)$$

$$Pb \rightarrow Pb^{2+} + 2e^- \quad (7)$$

When ferrous ions are present in the electrolyte, in this case, too, reaction (5) in the above predominates over the reactions (6) and (7) to prevent dissolution of lead electrode.

The ferrous ions which have been oxidized in accordance with equation (5) are then precipitated as sludge in the electrolyte.

It is to be noted that in addition to hydrogen formation iron sometimes deposits on cathodic portions of the wire surface when operated at a high current density in accordance with the following equation:

$$Fe^{2+} + 2e^- \rightarrow Fe \quad (8)$$

Because of this iron deposition, the wire surface turns black and this lowers the product value remarkably. Therefore, the addition of ferric ions to an electrolyte is desirable, though not always necessary, only at the beginning of the operation at a high current density, since in the presence of ferric ions the following reaction takes place instead of reaction (8) in the above.

$$Fe^{3+} + e^- \rightarrow Fe^{2+}. \quad (9)$$

Thus, in a preferred embodiment of the present invention method, a small amount of ferric ions is added to an electrolyte containing ferrous ions so as to prevent the deposition of iron on cathodic portions of the wire surface.

The concentration of ferrous ions in the electrolyte composed of an aqueous solution of an alkali metal salt, as hereinafter described in more detail, is more than 0.2% by weight on the basis of ferrous chloride or sulfate, preferably more than 1.0%. When the ferrous chloride or sulfate is added in an amount of more than 0.2% by weight to the electrolyte, the consumption loss of a graphite electrode is reduced to at least one half compared with the case in which it is not added. When it is added in an amount of more than 1.0% by weight, no significant consumption loss of the graphite electrode is found. The ferrous chloride or sulfate may be added to the electrolyte until it is saturated. That is, the upper point of the concentration of ferrous ions is the solubility thereof.

Ferric chloride or sulfate may also be added in an amount of more than 0.1% by weight of the electrolyte.

As hereinbefore mentioned, since, according to the present invention, the formation of sludge during operation is inevitable, a larger amount of sludge is formed compared with the method which does not use ferrous ions. Thus, it is necessary to remove the sludge from the electrolyte during operation so as not only to maintain the effectiveness of the electrolyte for a longer period of time, but also to make it effective to wash the descaled wire after descaling. Thus, it is desirable to provide a means of removing sludge and of supplying ferrous ions during operation in an apparatus of the present invention.

The present invention will be further described in conjunction with the drawings in which.

Figure 1:
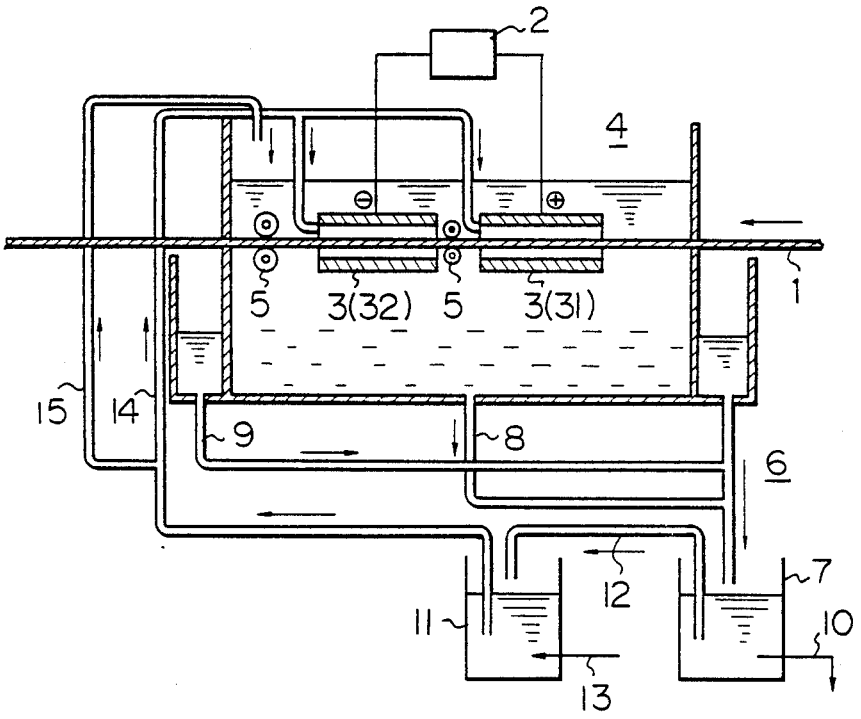
FIG. 1 is a diagrammatical view showing partly in section the apparatus of the present invention for electrolytically descaling a steel wire by a non-contact current flow method.

Now referring to FIG. 1 an apparatus for continuous electrolytic descaling of a steel wire 1 is shown, which comprises, essentially, a direct power source 2, a plurality of electrodes 3 (only one pair of electrodes is shown), a series of electrolytic cells 4 (only one cell 4 is shown), guide rollers 5, and an electrolytic solution circulating system 6. The electrolytic circulating system 6 comprises a sludge removing means and a means of adjusting the ferrous ion concentration in the electrolyte. Details including pumps, valves and so on are eliminated for the purpose of clarification.

A pair of the electrodes 3 consists of an anodic electrode 31 connected to the anode (+) of the direct current power source 2 and a cathodic electrode 32 connected to the cathode (−) of the direct current power source 2. The electrode may be either the tube type as shown or the plate type. The plate type electrodes may consists either of two plate electrodes opposed either vertically or horizontally with spacers of insulating material therebetween or may consist of four plate electrodes assembled into a tube having a square or rectangular section.

The method of the present invention is applied to a steel wire 1–40 mm in diameter, which, prior to the introduction into the electrolyte containing ferrous ions, is repeatedly bent and stretched by 1–20% in elongation with a roll-bender (not shown). Thereafter, the wire having been subjected to roll-bending is supplied to a series of electrolytic cells 4 provided with a means of removing sludge and a means of adjusting the electrolyte in accordance with the present invention. The electrolyte which is useful for a non-contact current flow method is: (1) 1–30% aqueous solution of alkali metal chloride (e.g. NaCl, KCl, etc.) containing ferrous chloride in an amount of from 0.2% by weight to the solubility thereof, and if necessary, in addition thereto ferric chloride in an amount of from 0.1% by weight to the solubility thereof, or (2) 1–30% aqueous solution of alkali metal sulfate (e.g. $Na_2SO_4$, $K_2SO_4$, etc.) containing ferrous sulfate in an amount of from 0.2% by weight to the solubility thereof, and if necessary in addition thereto ferric sulfate ($Fe_2(SO_4)_3$) in an amount of from 0.1% by weight to the solubility thereof.

The current density supplied during operation of descaling is desirably from 5 A/dm$^2$ to 500 A/dm$^2$. At a current density lower than 5 A/dm$^2$, the rate of electrolytic descaling is so small that too long a time is required to finish the descaling. Therefore, such a low current density is not suitable for high speed descaling. At a current density higher than 500 A/dm$^2$, the desirable effect due to the presence of ferrous ions in the electrolyte seems to be off-set, resulting in such disadvantages as mentioned hereinbefore with respect to the prior art.

The electrode is made of graphite in case of an electrolyte comprised of an aqueous solution of alkali metal chloride and is made of lead in case of an electrolyte comprised of an aqueous solution of alkali metal sulfate.

The electrolytic descaling is carried out in the presence of ferrous ions in accordance with the present invention. FIG. 1 shows only one electrolytic cell, but usually steel wire is passed through four or more electrolytic cells in series.

Since the present invention utilizes intentional addition of ferrous ions to an electrolyte, a large amount of ferrous and ferric chloride or sulfate is precipitated as sludge within the cell. Therefore, it is necessary to remove the sludge comprised of these sulfate and chlorides from the electrolyte. In addition, when ferrous ions are consumed in the process of electrolytic descaling of the present invention, it is also necessary to add ferrous ions to the electrolyte so as to maintain the ferrous ion concentration on a predetermined level.

As hereinbefore mentioned, the apparatus of the present invention comprises the electrolyte solution circulating system 6 including a sludge removing means and the electrolyte adjusting means. The sludge removing means may include a solid-liquid separator 7, such as a super decanter using centrifugal force separation, a filter provided with filter cloth, a thickner utilizing settling separation etc. A stream of an electrolyte is passed to the solid-liquid separator 7 via lines 8 and 9, in which sludge is separated from the electrolyte and discharged through the line 10, as shown by an arrow. The electrolyte after removal of the sludge is passed to a tank 11 via line 12, where its pH is adjusted by the addition of HCl or $H_2SO_4$ and if necessary alkali metal chloride or sulfate and ferrous chloride or sulfate are added to the electrolyte through the line 13 as shown by an arrow.

The recovered sludge, after neutralization with caustic soda and water, is disposed of.

The electrolyte, after adjustment of its pH and concentration of electrolytic components and ferrous ions, is recycled to the electrolytic cell 4 via lines 14 and 15. The circulating rate of the electrolyte is above 0.1 m/sec so that the electrolytic activity of the electrolyte at the steel wire surface and the concentration of ferrous ions are maintained at predetermined levels, i.e. as the same as of the bulk solution.

As hereinbefore mentioned, only one electrolytic cell 4 is shown in FIG. 1, though usually four or more cells are used in series. Therefore, the electrolytic circulation system 6 shown in FIG. 1 may also be provided in each of them, or only one such system may be provided. In the latter case, the lines 8 and 9 collect the electrolyte discharged from all the cells and the lines 14 and 15 distribute the regenerated electrolyte to each of them.

EXAMPLE 1

An aqueous 10% sodium chloride solution containing varied amounts of ferrous chloride was used to carry out the electrolytic descaling of a steel wire using a pair of electrolytic cells shown in FIG. 1. The anodic current density was 40 A/dm$^2$ and the temperature of the electrolyte was 40° C. The results are summarized in FIG. 2.

Figure 2:
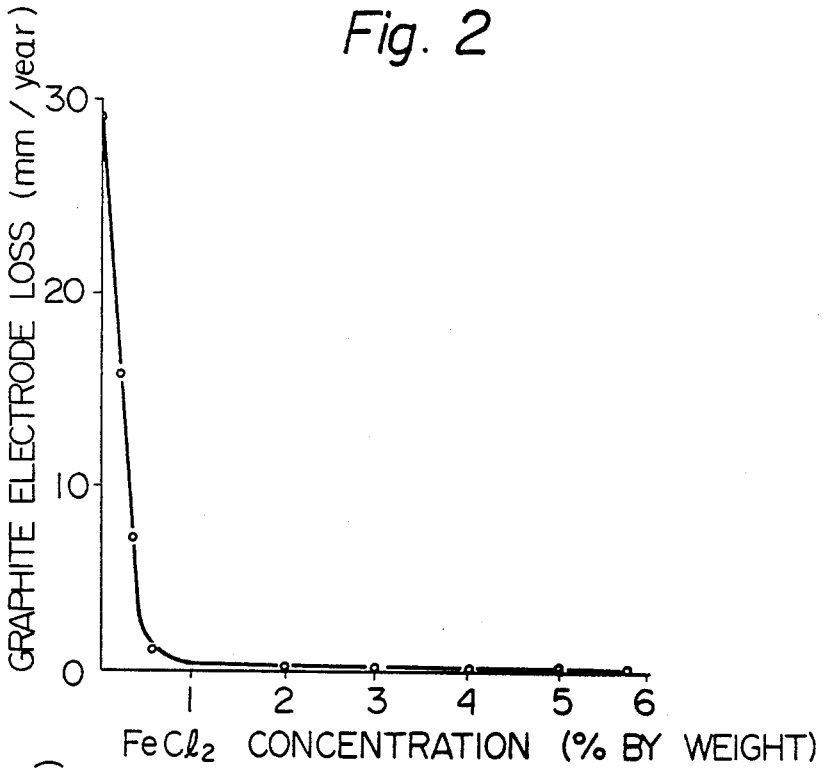
FIG. 2 is a graph showing the consumption loss of a graphite electrode with respect to the concentration of ferrous chloride in an electrolyte comprised of an aqueous solution of sodium chloride.

The consumption loss of graphite anode was determined in terms of decrease in thickness (mm) per year. The relation between the concentration of ferrous ions designated in terms of the concentration of ferrous chloride and the consumption of the graphite electrode is shown in FIG. 2. As is apparent from FIG. 2, the loss of the electrode is reduced one half that experienced when ferrous chloride was not added to the electrolyte at the concentration level of 0.2% by weight of ferrous chloride.

EXAMPLE 2

In this example, Example 1 was repeated except that an electrolyte was comprised of an aqueous 10% sodium sulfate solution containing varied amounts of ferrous sulfate. The electrode was made of lead.

Figure 3:
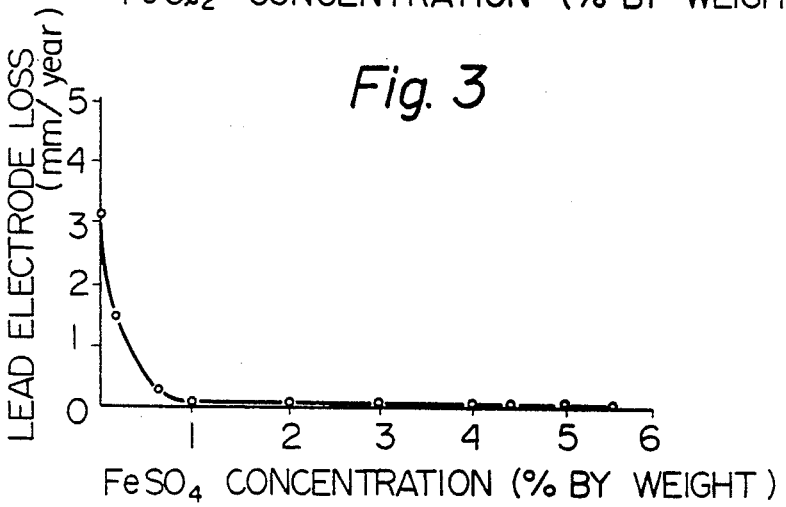
FIG. 3 is a graph showing the consumption loss of a lead electrode with respect to the concentration of ferrous sulfate in an electrolyte comprised of an aqueous solution of sodium sulfate.

The results are summarized in FIG. 3, which shows the relation between the concentration of ferrous ions designated in terms of the concentration of ferrous sulfate and the consumption of the lead electrode. The consumption of the electrode was determined in terms of decrease in thickness (mm) per year. As is apparent from FIG. 3, at the concentration level of 0.2% by weight of ferrous sulfate the electrode loss is reduced one half that experienced when ferrous sulfate was not added to the electrolyte.

EXAMPLE 3

In this example, it is determined that the concentration of ferrous and ferric ions have influence on the formation of chlorine gas. In this example, Example 1 was repeated except that descaling conditions designated in Table 1 were used. The descaling conditions and results are summarized in Table 1.

As is apparent from the data shown in Table 1, the addition of 0.2% $FeCl_2$ to an electrolyte comprised of a 10% aqueous solution of sodium chloride reduced the formation of chlorine gas one half that formed in the case in which ferrous chloride was not added. When ferrous chloride was added in an amount of more than 1.0%, chlorine gas was not found at all. Thus, according to the present invention it is possible to carry out efficient descaling of steel wire.

As the current density increases above 40 A/dm$^2$, the rate of descaling also increases. It is to be noted, on the other hand, that at a higher current density, the addition of a small amount of ferric chloride is desirable in order that the deposition of iron according to the equation: $Fe^{2+} + 2e^- \rightarrow Fe$ is successfully prevented in cathodic portions of the steel wire being treated.

EXAMPLE 4

In this example, Example 3 was repeated except that ferrous sulfate was added to an electrolyte comprised of an aqueous solution of sodium sulfate. The dissolution of lead electrode is accompanied by the generation of oxygen gas. Therefore, in this example, the consumption of the electrode is presumed to be approximately in accordance with the volume of oxygen generated during operation. The descaling conditions and results are summarized in Table 2.

As is apparent from the data shown in Table 2, the addition of ferrous sulfate in an amount of more than 2.0% reduced the consumption of the electrode designated in terms of thickness (mm) per year to at least one half that experienced when no ferrous sulfate was added. By the addition thereof in an amount of more than 1%, the consumption of the electrode can be substantially prevented.

TABLE 1

Descaling of Steel Wire in an Electrolyte NaCl + $FeCl_2$ Circulating at 40° C.

| Steel wire | Electrolyte (%) NaCl | $FeCl_2$ | $FeCl_3$ | Current density ($A/dm^2$) | Time of[1] polarity of steel wire cathode-anode | de-[2] scaling | $Cl_2$[3] formation | Remarks |
|---|---|---|---|---|---|---|---|---|
| Green rod | 10 | 0 | 0 | 40 | 10–10 | Δ | X | comparative |
| without | 10 | 0 | 0 | 80 | 6–6 | O | XX | |
| rust | 10 | 0 | 0 | 120 | 4–4 | O | XX | |
| | 10 | 0.3 | 0 | 40 | 10–10 | Δ | Δ | this invention |
| | 10 | 0.5 | 0 | 40 | 10–10 | Δ | Δ | |
| | 10 | 1.0 | 0 | 40 | 10–10 | O | O | |
| | 10 | 5.0 | 0 | 40 | 10–10 | O | O | |
| | 10 | 10.0 | 0 | 40 | 10–10 | O | O | |
| | 10 | 29 (saturated) | 0 | 40 | 10–10 | O | O | |
| | 10 | 5.9 | 0.5 | 30 | 6–6 | O | O | |
| | 10 | 5.0 | 1.0 | 120 | 4–4 | O | O | |
| | 3 | 5.0 | 0 | 40 | 10–10 | Δ | O | |
| | 20 | 5.0 | 0 | 40 | 10–10 | O | O | |
| | 10 | 5.0 | 1.0 | 500 | 1–1 | O | O | |
| | 10 | 5.0 | 1.0 | 600 | 1–1 | O | XX | comparative |
| Rod | 10 | 0 | 0 | 120 | 4–4 | O | XXX | |
| with | 10 | 0 | 0 | 240 | 3–3 | O | XXX | |
| red | 10 | 0 | 0 | 300 | 25–25 | O | XXX | |
| rust | 10 | 5.0 | 0 | 40 | 10–10 | Δ | O | this invention |
| | 10 | 5.0 | 0.5 | 80 | 6.5–6.5 | O | O | |
| | 10 | 5.0 | 0.5 | 120 | 4.5–4.5 | O | O | |
| | 10 | 5.0 | 1.0 | 240 | 3–3 | O | O | |
| | 10 | 5.0 | 1.0 | 300 | 2.5–2.5 | O | O | |

Note:
[1]Descaling time was varied by changing the feed rate of the steel wire. Cathode-Anode 10–10 means that the steel wire resides within the tube graphite electrode the length of which is 1000 mm for 10 seconds for cathodic electrode and for 10 seconds for anodic electrode.
[2]O: good surface finish. Δ: slightly inferior surface finish
[3]O: none, Δ: relatively small, X: marked, XX: vigorous, XXX: extreme excess

TABLE 2

Descaling of Steel Wire in an Electrolyte of $Na_2SO_4$ + $FeSO_4$ Circulating at 40° C.

| Steel wire | Electrolyte (% by weight) $Na_2SO_4$ | $FeSO_4$ | $Fe_2(SO_4)_3$ | Current density ($A/dm^2$) | Time of[1] polarity of steel wire (sec) Cathode-Anode | Descal-[2] ing | $O_2$[3] formation | Remark |
|---|---|---|---|---|---|---|---|---|
| Green rod | 10 | 0 | 0 | 40 | 10–10 | Δ | X | comparative |
| without | 10 | 0 | 0 | 80 | 6–6 | O | XX | |
| rust | 10 | 0 | 0 | 120 | 4–4 | O | XXX | |
| | 10 | 0.2 | 0 | 40 | 10–10 | Δ | Δ | this invention |
| | 10 | 0.6 | 0 | 40 | 10–10 | Δ | Δ | |
| | 10 | 1.0 | 0 | 40 | 10–10 | O | O | |
| | 10 | 5.0 | 0 | 40 | 10–10 | O | O | |
| | 10 | 10.0 | 0 | 40 | 10–10 | O | O | |
| | 10 | 22 (saturated) | 0 | 40 | 10–10 | O | O | |
| | 10 | 5.0 | 0.5 | 50 | 7–7 | O | O | |
| | 10 | 5.0 | 1.0 | 120 | 5–5 | O | O | |
| | 5 | 5.0 | 0 | 40 | 10–10 | X | O | |
| | 15 | 5.0 | 0 | 40 | 10–10 | O | O | |
| | 10 | 5.0 | 1.0 | 500 | 1–1 | O | O | |
| | 10 | 5.0 | 1.0 | 550 | 1–1 | O | X | comparative |
| Rod | | | | | | | | |
| with | 10 | 0 | 0 | 120 | 4–4 | O | XXX | |
| red | 10 | 0 | 0 | 240 | 3–3 | O | XXX | |
| rust | 10 | 0 | 0 | 300 | 2.5–2.5 | O | XXX | |
| | 15 | 5.0 | 1.0 | 120 | 5.5–5.5 | O | O | this |

TABLE 2-continued

| Steel wire | Descaling of Steel Wire in an Electrolyte of $Na_2SO_4$ + $FeSO_4$ Circulating at 40° C. Electrolyte (% by weight) $Na_2SO_4$ | $FeSO_4$ | $Fe_2(SO_4)_3$ | Current density ($A/dm^2$) | Time of[1] polarity of steel wire (sec) Cathode-Anode | Descaling[2] | $O_2$[3] formation | Remark |
|---|---|---|---|---|---|---|---|---|
| | | | | | | | | invention |
| | 15 | 5.0 | 1.0 | 200 | 4–4 | O | O | |
| | 15 | 5.0 | 1.0 | 300 | 3–3 | O | O | |

Note:
[1], [2] and [3] are the same as in TABLE 1.

What we claim is:

1. In a method of electrolytic descaling of a steel wire by non-contact current flow method, in which a direct current is supplied to a pair of electrodes and then to the steel wire through an electrolyte without using direct contact, the steel wire is transported past the pair of the electrodes immersed in the electrolyte throughout the operation, the electrodes are made of graphite and the electrolyte is comprised of 1–30% aqueous solution of an alkali metal chloride selected from the group consisting of sodium chloride, potassium chloride and lithium chloride, the improvement that the descaling is carried out in the presence of ferrous ions in the electrolyte, the ferrous ions being derived from ferrous chloride added to the electrolyte in an amount of more than 0.2% by weight of the electrolyte.

2. A method of claim 1, in which the ferrous chloride is added to the electrolyte in an amount of more than 1.0% by weight of the electrolyte.

3. A method of claim 1, in which ferric ions are added to the electrolyte in an amount of 0.1% or more on the basis of the weight of ferric chloride.

4. A method of any of claims 1, 2 or 3 in which the descaling is carried out at a current density higher than 50 $A/dm^2$.

5. In a method of electrolytic descaling of a steel wire by non contact current flow method, in which a direct current is supplied to a pair of electrodes and then to the steel wire through an electrolyte without using direct contact, the steel wire is transported past the pair of the electrodes immersed in the electrolyte throughout the operation, the electrodes are made of lead and the electrolyte is comprised of 1–30% aqueous solution of an alkali metal sulfate selected from the group consisting of sodium sulfate and potassium sulfate, the improvement that the descaling is carried out in the presence of ferrous ions in the electrolyte, the ferrous ions being ones derived from ferrous sulfate added to the electrolyte in an amount of more than 0.2% by weight of the electrolyte.

6. A method of claim 5, in which the ferrous sulfate is added to the electrolyte in an amount of more than 1.0% by weight of the electrolyte.

7. A method of claim 5, in which ferric ions are added to the electrolyte in an amount of 0.1% or more on the basis of the weight of ferric sulfate.

8. A method of any of claims 4, 5, 6 or 7 in which the descaling is carried out at a current density higher than 50 $A/dm^2$.

* * * * *

UNITED STATES PATENT AND TRADEMARK OFFICE

CERTIFICATE OF CORRECTION

PATENT NO. 4,276,133

DATED : June 30, 1981

INVENTOR(S) : H. Nagano et al

It is certified that error appears in the above-identified patent and that said Letters Patent are hereby corrected as shown below:

The Assignee should read as follows:

-- Sumitomo Metal Industries, Ltd. --

Claim 8 is improperly dependent and should be amended to:

"A method of any of Claim 5, 6, or 7 in which --.

Signed and Sealed this

*Seventeenth* Day of *November 1981*

[SEAL]

*Attest:*

GERALD J. MOSSINGHOFF

*Attesting Officer*

*Commissioner of Patents and Trademarks*